United States Patent [19]

Malone

[11] 4,231,489

[45] Nov. 4, 1980

[54] CONTAINER DEPRESSURIZATION SYSTEM

[76] Inventor: Carl E. Malone, 2281 SW. 33rd Way, Fort Lauderdale, Fla. 33312

[21] Appl. No.: 46,467

[22] Filed: Jun. 7, 1979

[51] Int. Cl.[3] ..... B65D 53/00

[52] U.S. Cl. ..... 220/304; 220/366; 220/367; 215/307

[58] Field of Search ..... 220/303, 304, 366, 367; 215/307, 354

[56] References Cited

U.S. PATENT DOCUMENTS

| | | | |
|---|---|---|---|
| 2,965,256 | 12/1960 | Yochem | 215/354 X |
| 3,198,374 | 8/1965 | Lindner et al. | 220/304 |
| 3,302,664 | 2/1967 | Plamann | 220/304 X |
| 3,819,040 | 6/1974 | Coons | 220/378 X |

*Primary Examiner*—George T. Hall
*Attorney, Agent, or Firm*—Harness, Dicky & Pierce

[57] ABSTRACT

A container sealing system is disclosed herein for use in conjunction with a refillable container having a resealable closure member associated therewith. The sealing system includes a first fluid tight sealing member disposed between and engageable with the closure member and the container and a second sealing member integrally formed on the closure member and engageable with a portion of the container so as to prevent nongaseous contents of the container from leaking into the area of threaded engagement between the closure member and container. A vent passage is also provided in the closure member which is operative to provide safe controlled relief of pressure within the container in response to partial removal and prior to full removal of the closure member.

12 Claims, 3 Drawing Figures

CONTAINER DEPRESSURIZATION SYSTEM

BACKGROUND AND SUMMARY OF THE INVENTION

The present invention relates generally to reuseable sealing systems for containers and more specifically to a controlled pressure relieving dual sealing arrangement employing spaced gaseous and nongaseous fluid sealing means for use in conjunction with a liquid dispensing container.

In designing refillable pressurized liquid dispensing containers, it is necessary to provide secure sealing means to maintain the fluid under pressure and which sealing means must be designed to allow repeated removal and reinstallation of the closure member without damage thereto. Further, it is also desirable to incorporate into the container means for relieving any residual internal pressure from the container under controlled conditions so as to enable the container to be refilled.

Various sealing arrangements have been designed for use in conjunction with such containers; however, none of these arrangements have proven totally satisfactory. In one such design, a single seal is disposed in the closure member at a location so as to engage the outer edge portion of the container defining the opening therein. While this arrangement provides an adequate seal between the closure member and container, it is difficult to achieve a gradual release of internal pressure as venting will occur around the entire periphery of the opening simultaneously. Also, if the seal is to be positioned in the sidewall of the closure member, relatively complicated collapsable molding cores must be employed or other machining operations must be performed in order to provide a suitable recess for retaining the seal in position. While the seal could be positioned on the sidewall of the container adjacent the threaded portion, it may be damaged by the threads of the closure member passing across it if located adjacent the outer end. Positioning the seal on the container adjacent the inner end of the threaded portion is preferable to prevent damage to the seal, however, this may allow a portion of the container contents to accumulate within the threads thereby hindering removal of the closure member for refilling.

The present invention, however, provides a sealing arrangement for a pressurizable refillable dispensing container which overcomes these disadvantages by employing first and second spaced sealing means which are operative to effectively maintain the container in a pressurized condition and also operate to prevent the nongaseous contents of the container from entering and becoming trapped in the area of threaded engagement between the closure member and container. This sealing arrangement thus prevents contamination of as well as build-up of deposits on the mutually engaging threaded surfaces of the container and closure member which may result in sticking thereof, excessive wear of the threads over a period of time, or result in premature leakage. Additionally, because the nongaseous contents cannot become trapped within the area of threaded engagement, the possibility of the nongaseous contents being blown out onto the user when the container is opened are substantially reduced thus eliminating messy cleanup. Further, the sealing arrangement is particularly well suited for economical fabrication from suitable polymeric materials such as by a suitable molding process.

Controlled pressure relief means are also incorporated into the cover member which operate to gradually relieve internal pressure under controlled conditions as the closure member is partially removed from the container.

Additional advantages and features of the present invention will become apparent from the subsequent description and the appended claims taken in conjunction with the accompanying drawings.

DESCRIPTION OF THE PREFERRED EMBODIMENT

Figure 1:
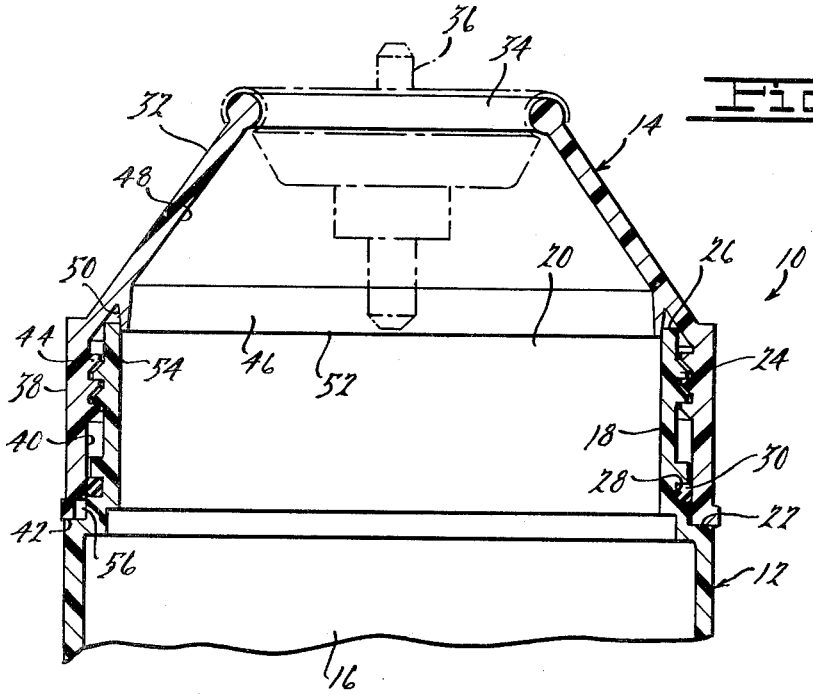
FIG. 1 is a sectional view of a portion of a container in accordance with the present invention, the section being taken along a diametric plane lying parallel to the longitudinal axis of the container.

Referring now to the drawings and in particular to FIG. 1, there is shown a dispensing container assembly in accordance with the present invention indicated generally at 10 and including a container 12 having a closure member 14 secured thereto.

Container 12 includes a body portion 16 having a reduced diameter generally cylindrical flange portion 18 defining an opening 20 in one end thereof and a radially extending shoulder portion 22 extending between and interconnecting flange portion 18 and body portion 16. Flange portion 18 has a plurality of helical threads 24 provided on the periphery thereof adjacent the outer end 26 thereof and an annular groove 28 formed between shoulder portion 22 and threads 24 in which a seal 30 preferably in the form of an O ring is disposed.

Closure member 14 is generally cylindrically shaped having a generally frusto conically shaped end wall 32 which is provided with an opening 34 adapted to accommodate a dispensing valve assembly 36 and a depending flange portion 38. Flange portion 38 has a generally smooth inner peripheral surface 40 adjacent the outer end 42 thereof and is provided with a plurality of inwardly extending helical threads 44 which threads are adapted to engage threads 24 provided on flange portion 18 of container 12. A depending integrally formed annular flange portion 26 is also integrally formed with closure member 14 extending inwardly from the inner surface 48 of end wall 32. Preferably, outer sidewall 50 of annular flange portion 46 will taper radially inwardly toward lower edge 52 thereof which will be positioned slightly radially inwardly from flange portion 38 so as to allow sidewall 50 to resiliently engage the inner surface 54 of flange portion 18 as closure member 14 is secured to container 12 thereby creating a nongaseous seal therebetween.

A relatively small notch or cut out portion 56 is also provided in surface 40 of closure member 14 extending axially inwardly from outer end 42 a relatively short distance preferably slightly less than the distance between groove 28 and shoulder 22.

It should be noted that as shown container 12 and closure member 14 are both preferably fabricated from a suitable polymeric composition, however, either or both members may also be fabricated from any other suitable material.

In order to utilize the dispensing container of the present invention, container 12 is first filled with the material to be dispensed therefrom, usually a liquid material or solid material such as a powder. Thereafter closure member is threaded onto container 12 thereby causing surface 40 to be moved downwardly along flange portion 18 and over seal 30 thereby compressing seal 30 within groove 28 and forming a gas tight sealing relationship therebetween. Also, annular flange portion 46 will be moved into opening 20 thus advancing surface 50 into a resilient engagement with the inner surface 54 of flange portion 18 thereby creating a nongaseous sealing relationship therebetween so as to effectively prevent the liquid or solid nongaseous contents of the container from entering the area of threaded engagement between closure member 14 and container 12 during use of the dispensing apparatus. The sealed container assembly may then be pressurized so as to allow the contents thereof to be easily dispensed as required through valve assembly 36.

Figure 2:
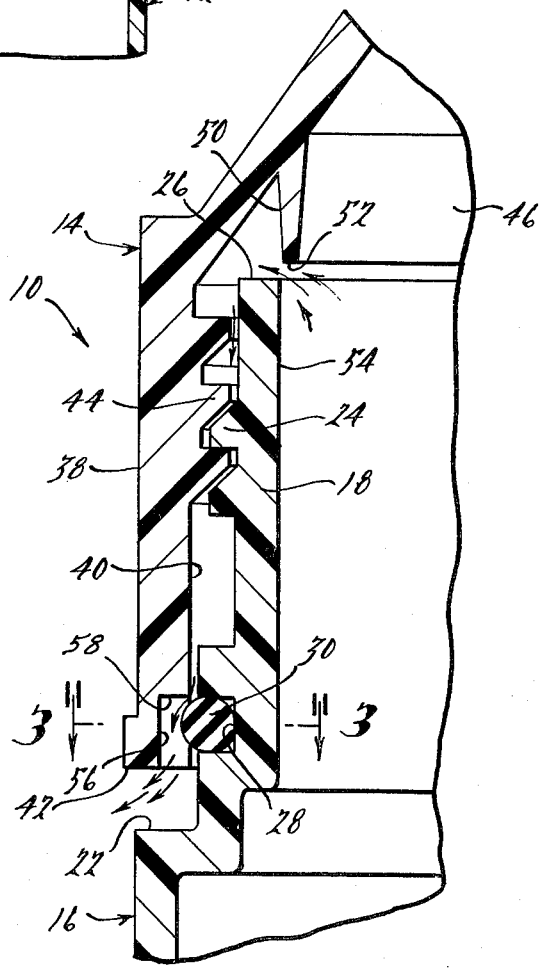
FIG. 2 is an enlarged sectioned fragmentary view of a portion of the container of FIG. 1 showing the closure member in a partially removed venting position, the section being taken along a radial plane extending parallel to the longitudinal axis.
Figure 3:
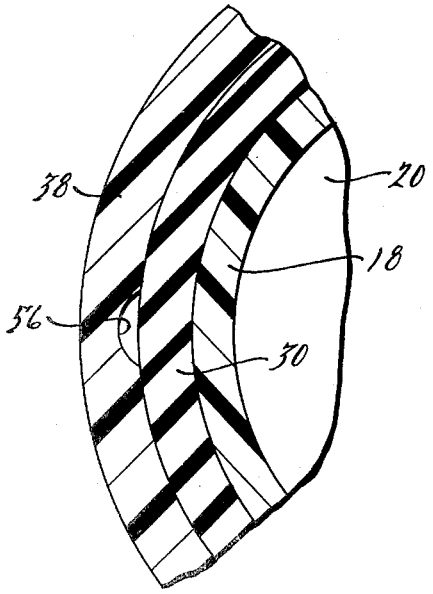
FIG. 3 is a fragmentary sectioned view of the container of FIG. 2 showing the vent passage provided in the closure member, the section being taken along line 3—3 of FIG. 2.

When it becomes necessary to refill the container assembly, closure member 14 is rotated relative to container 12 thereby causing notch 56 to move axially upwardly into radial alignment with seal 30 thereby providing a venting passage around seal 30 as best seen with reference to FIG. 2. Simultaneously, annular flange portion 46 will be moved upwardly out of engagement with surface 54 of flange portion 18. Thus, any residual pressure remaining may be easily vented along the path indicated by the arrows in FIG. 2. As shown, groove 28 will be spaced from the annular shoulder 22 a distance greater than the cross sectional diameter of O ring seal 30 and notch 56 will have an axial dimension slightly greater than this diameter of seal yet slightly less than the spacing between groove 28 and shoulder 22. Thus, when end portion 42 engages shoulder 22, the inner end 58 of notch 56 will be spaced below the lower edge of groove 28 so as to assure full sealing engagement between seal 30 and surface 40. As closure member is moved outwardly relative to container 12 and notch 56 moves upwardly into radial alignment with seal 30, surface 40 on either side of notch 56 will still engage seal 30 so as to prevent the vented pressure from dislodging seal 30. Also, it should be noted that the size of the vent passage provided by notch 56 will initially be very small and will increase with continued rotation of closure member 14 relative to container 12 so as to thereby allow a controlled release of pressure from within container assembly 10. As seen in FIG. 2, when closure member 14 is in the venting position, at least one or more threads 24 and 44 will be engaged so as to retain closure member 14 on container 12.

The nongaseous seal provided by the resilient engagement of surface 50 of annular flange portion 46 and surface 54 of flange 18 will prevent the entry and entrapment of the material to be dispensed from the container within the area of threaded engagement between closure member 14 and container 12 thereby preventing material from being blown out notch 56 during venting of the container assembly.

The present invention thus provides a refillable pressure dispensing container assembly which includes a two stage sealing arrangement particularly designed to allow safe, controlled clean venting of residual internal pressure without loss of any of the material remaining within the container thereby eliminating the possibility of injury or messy cleanup work before refilling of the container. It should be noted that while the present invention has been described with application to a refillable pressure dispensing container, it is equally useful with any other storage, packaging or dispensing type container assemblies.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

I claim:

1. An improved sealing means for a refillable container assembly comprising a container having an opening at one end thereof, a closure member for closing said opening, and cooperating retaining means provided on said container and said closure member for removably retaining said closure member on said container, said improved sealing means comprising:

first sealing means provided on an outer sidewall of said container between said retaining means and the end of said container opposite said one end and operative to engage said closure member to form a fluid tight seal between said closure member and said container; and second sealing means disposed between the interior of said container and said retaining means, said second sealing means engaging and creating a sealing relationship between said closure member and said container so as to prevent nongaseous material within said container from reaching said retaining means.

2. A sealing means as set forth in claim 1 wherein said second sealing means is integrally formed on one of said closure member and said container.

3. A sealing means as set forth in claim 2 wherein said second sealing means comprises a depending flange integrally formed on said closure member.

4. A sealing means as set forth in claim 3 wherein said flange portion includes a radially outer surface resiliently engageable with the periphery of said container defining said opening.

5. A sealing means as set forth in claim 1 wherein said closure member includes venting means, said closure member being movable to a position in which said venting means is operative to relieve internal pressure from said container.

6. A sealing means as set forth in claim 5 wherein said venting means comprises an axially extending cut out portion in said closure means, said cut out portion being operative to provide a passage around said first sealing means when moved into radial alignment with said first sealing means.

7. A sealing means as set forth in claim 1 wherein said second sealing means comprises a depending flange portion integrally formed on said closure member, said flange portion including a radially outer surface engageable with the peripheral portion of said container defining said opening and said first sealing means includes an annular groove formed on said container and a seal disposed within said groove.

8. A sealing means as set forth in claim 7 wherein said closure member includes venting means, said closure member being movable to a position in which said venting means is operative to relieve internal pressure from said container.

9. An improved sealing means for a refillable container assembly comprising a container having an opening at one end thereof, a closure member for closing said opening, and cooperating retaining means provided on said container and said closure member for removably retaining said closure member on said container, said improved sealing means comprising:

first sealing means disposed between said retaining means and the end of said container opposite said one end and operative to form a fluid tight seal between said closure means and said container, said first sealing means including an annular groove formed on one of said closure member and said container and a seal disposed within said groove;

second sealing means disposed between the interior of said container and said retaining means, said second sealing means engaging and creating a sealing relationship between said closure member and said container so as to prevent nongaseous material within said container from reaching said retaining means, said second sealing means including a depending flange portion integrally formed on said closure member, said flange including a radially outer surface engageable with the peripheral portion of said container defining said opening, said closure member having an axially extending cutout portion, said cutout portion being operative to provide a vent passage across said seal and said depending flange portion being moved out of engagement with said peripheral portion when said closure member is moved to a venting position so as to thereby release pressure from within said container.

10. A sealing means as set forth in claim 9 wherein said retaining means comprises mutually engaging threads provided on said closure member and said container.

11. A sealing means as set forth in claim 1 wherein said second sealing means comprise an annular depending flange portion provided on said closure member, said depending flange portion being defined by converging radially inner and outer sidewalls.

12. A sealing means as set forth in claim 11 wherein one of said radially inner and outer sidewalls is resiliently engageable with the periphery of said container defining said opening.

* * * * *

UNITED STATES PATENT AND TRADEMARK OFFICE

CERTIFICATE OF CORRECTION

PATENT NO. : 4,231,489

DATED : November 4, 1980

INVENTOR(S) : Carl E. Malone

It is certified that error appears in the above-identified patent and that said Letters Patent are hereby corrected as shown below:

Column 2, line 56: "26" should be --46--

Signed and Sealed this

*Thirteenth* Day of *January 1981*

[SEAL]

*Attest:*

SIDNEY A. DIAMOND

*Attesting Officer*

*Commissioner of Patents and Trademarks*